US006905025B2

(12) United States Patent
Morin

(10) Patent No.: US 6,905,025 B2
(45) Date of Patent: Jun. 14, 2005

(54) CONTAINER FOR A STACK OF INTERFOLDED TISSUE SHEETS

(75) Inventor: Emmanuelle Morin, Paris (FR)

(73) Assignee: SCA Hygiene Products GmbH, Mannheim (DE)

( * ) Notice: Subject to any disclaimer, the term of this patent is extended or adjusted under 35 U.S.C. 154(b) by 142 days.

(21) Appl. No.: 10/345,193

(22) Filed: Jan. 16, 2003

(65) Prior Publication Data

US 2003/0155264 A1 Aug. 21, 2003

(30) Foreign Application Priority Data

Feb. 15, 2002 (EP) ..... 02445023.1

(51) Int. Cl.[7] ..... B65D 73/00; B65H 1/00; A47K 10/24

(52) U.S. Cl. ..... 206/494; 206/233; 206/812; 206/449; 221/48; 221/55; 221/63

(58) Field of Search ..... 206/494, 233, 206/812, 449; 221/48, 55, 63

(56) References Cited

U.S. PATENT DOCUMENTS

| | | | | | |
|---|---|---|---|---|---|
| 2,580,982 | A | * | 1/1952 | Weiss | 221/48 |
| 2,840,266 | A | * | 6/1958 | Nelson | 221/48 |
| 2,840,267 | A | * | 6/1958 | Nelson | 221/48 |
| 3,224,632 | A | | 12/1965 | Marcalus | |
| 3,369,699 | A | * | 2/1968 | Enloe et al. | 221/48 |
| 3,780,908 | A | * | 12/1973 | Fitzpatrick et al. | 221/48 |
| 4,535,912 | A | * | 8/1985 | Bonk | 221/46 |
| 4,586,630 | A | * | 5/1986 | Loder | 221/46 |
| 4,785,970 | A | * | 11/1988 | Engelmayer | 221/47 |
| 4,848,575 | A | * | 7/1989 | Nakamura et al. | 206/449 |
| 5,699,912 | A | | 12/1997 | Ishikawa et al. | |
| 6,053,357 | A | | 4/2000 | Yoh | |
| D445,028 | S | * | 7/2001 | Grubstein | D9/447 |
| 6,409,044 | B1 | * | 6/2002 | Brown et al. | 221/63 |

FOREIGN PATENT DOCUMENTS

| | | | | |
|---|---|---|---|---|
| DE | 3602850 A1 | * | 9/1986 | B65D/83/08 |
| WO | WO 01/74694 | | 10/2001 | |

* cited by examiner

*Primary Examiner*—Derris H. Banks
*Assistant Examiner*—Dmitry Suhol
(74) *Attorney, Agent, or Firm*—Young & Thompson

(57) ABSTRACT

A container for a stack of interfolded tissue-sheets has a generally planar top wall, a bottom wall, side walls and an opening provided in the top wall for the removal of tissue-sheets from the container. The opening is provided with elements for presenting the tissue, preferably in the form of elongated projections, extending in-between each other from opposite sides of the opening in a first, inactive position. Adjacent projections are spaced apart both in the first, inactive position, in which the projections are substantially in the same plane as the top wall, and in a second, active position, in which the projections are raised and impart a primary wave-shape to a tissue sheet in a presentation position. The opening has a main axis with a predetermined curvature, which opening imparts a secondary wave-shape to the tissue sheet in the presentation position when the projections are in the second, active position.

11 Claims, 5 Drawing Sheets

CONTAINER FOR A STACK OF INTERFOLDED TISSUE SHEETS

FIELD OF THE INVENTION

The invention pertains to a stack of interfolded tissue-sheets packed in a container, said container having a generally planar bottom wall and a top wall and side walls connecting the bottom wall with the top wall and an opening provided in at least one wall for the removal of said tissue-sheets from the container, said stack of interfolded tissue-sheets being placed in said container with at least the edges of a lowermost tissue-sheet placed on the bottom wall and an uppermost tissue-sheet placed near or in contact with the top wall and adjacent to the opening in the top wall.

BACKGROUND OF THE INVENTION

Soft tissue sheets such as facial tissue sheets are commonly offered as a stack of tissue sheets packed in a dispensing box. The dispensing box has an opening through which the user pulls the tissue sheets. In order to facilitate the removal of the tissue sheets from the dispensing box, the tissue sheets are interfolded, which means that the tissue sheets are folded into one-another, so that they form a chain of tissue sheets being interconnected by folded portions. In this manner, when removing the top tissue sheet from the stack of tissue sheets and pulling the tissue sheet completely through the dispensing opening in the dispensing box, the pulled-out tissue sheet will automatically bring a portion of the next tissue sheet in the stack out through the opening thereby making it readily available for gripping and removing from the dispensing box. The praxis of interfolding tissue sheets in this manner is a convenient way of ascertaining that all of the tissue sheets can be easily removed from the container. There are many types of interfolding, e.g. Z-folding, but neither the type of interfolding, nor the type of tissue is important to the invention.

A dispenser of this type is known from U.S. Pat. No. 6,053,357 (YOH), which discloses a box with an opening overlaid with a plastic film having a curvilinear or "S"-shaped slit. The opening facilitates the dispensing of interfolded tissues from a box by fixing the top sheet in a position extending out through the slit, where it is readily accessible to a user. One problem with this solution is how to extricate an uppermost tissue from the box, as a user may have difficulties in gripping a tissue through the narrow slit of the opening. Also, this type of narrow slit may cause a subsequent tissue to catch or be impeded by friction against the edges of the slit and fall back into the box when a preceding tissue is being pulled out. The document itself discloses problems with tearing of certain types of tissues. Furthermore, the extension of the "S"-shaped curves of the opening are relatively short, giving them an inherent limited movement or flexibility. This may cause problems with the presentation of a tissue, as the edges can not co-operate to any greater extent once they are raised upwards by a tissue being pulled from the box. Instead of holding the tissue in a presentation position the slit opening may end up with the edges one over the other, near the plane of the upper wall, with an interposed tissue lying on top of said wall.

Although some of the above problems may be solved by using a thinner or more flexible film, such a film may give rise to problems in connection with supporting and/or retaining a tissue in a presentation position, or even cause the tissue to fall back into the box.

Hence, there exists a need of improving the dispensing of soft tissue sheets from a stack of tissue sheets, which are packed in a dispensing box.

SUMMARY OF THE INVENTION

The above problems are solved by the container for a stack of interfolded tissue sheets according to the present invention.

In accordance with the invention the dispensing opening is provided with means for presenting a tissue blocked in a fixed position, with a controlled wrinkled configuration. This allows the user to pull the presented tissue out flat from the controlled wrinkled position in which it is held by the presenting means. The presented tissue may be a single sheet, or may itself have additional folding.

The means for presenting the tissue is preferably in the form of a number of elongated projections or fingers extending from opposite sides of the dispensing opening of the box. The dispensing opening is preferably, but not necessarily, located in the top wall of the box. In order to fix a tissue in position the fingers are overlapping by extending between each other. In the following text, the term "overlapping" is used in the context of projections or fingers extending from opposite directions, placed adjacent and in between each other, as seen in the plane of the top wall. Similarly, the term "opening" is assumed to encompass the general area delimited by any cut-out sections, projections, folding lines and/or perforated edges in the top wall, unless otherwise specified.

As the box is opened the fingers are initially arranged in substantially the same plane, or in adjacent parallel planes, until the first tissue has been extracted through the dispensing opening. The fingers may be attached to the underside of the top wall of the box, on opposite sides of the opening. It is also possible to integrate them into the top wall itself, e.g. by making the fingers part of the top wall. This can be done by making a blank having a complete set of fingers punched or cut in a single wall.

When the first tissue is being pulled out through the opening the fingers on both sides of the opening will be raised upward by the tissue. This will position the fingers extending from opposing edges on either side of a tissue. The pulled-out tissue will automatically bring a portion of the next tissue out through the opening, where it will pass between the fingers. As the first tissue is removed, the following tissue will be held in position and prevented from falling back into the box by the gripping action of the opposing fingers. The fingers must be sufficiently flexible to allow a tissue to be pulled out, while at the same time being sufficiently stiff to retain the tissue and prevent it from falling back into the box. In their active position the fingers extend upwards, with the tips of adjacent opposing fingers extending between and past each other. This will impart a primary wave-shape to the presented tissue sheet, causing the tissue to be wrinkled in a controlled manner as it is shaped by the fingers while being pulled from the box.

In order to avoid interference between pairs of adjacent projections or fingers it is important that they do not come into contact with each other, neither in their flat inactive positions nor in their raised active, dispensing, positions. The purpose of the projections is to achieve a controlled wrinkling of a tissue sheet to be dispensed, whereby the tissue sheet itself is supported by the individual projections without any assistance from a gripping action between adjacent projections.

This controlled wrinkling of the tissue reduces the projected edge-to-edge width of the tissue as seen or measured along the main axis of the opening. Irrespective of its radius or shape, the length of the opening as measured along the curved main axis may be substantially equal to or less than the actual width of the tissue sheet to be dispensed. As a first wave-shape is imparted to the presented tissue sheet by the projections, thus reducing the actual width, the length of the opening measured along the main axis of the opening can be selected within a range of value between said projected edge-to-edge width and a width slightly exceeding the actual projected width of the tissue sheet.

According to the invention, a tissue sheet may be stabilised further in the presentation position by giving the main axis of the opening a suitable curvature. According to one embodiment, the main axis can have an arcuate shape, that is a curve with a predetermined radius. Such a curved main axis may have the shape of an arc with a relatively large radius. Further embodiments include curvatures forming a half circle, or even a circle that is closed to a greater extent, whereby the ends of the opening are placed at a short distance from each other.

In the latter case, a central section is supported by a bridge or radial section. The radial section, interrupting the substantially closed circle of the main axis of the opening, must be sufficiently large and/or stiff to allow the projections extending radially outwards from said central section supported by the radial section to flex without any significant deformation of the central section, the radial section or the top wall itself. Such a substantially closed, circular main axis may encompass an angle of up to 300°. This angle is measured relative to the centre of the central section, covering the arc encompassed by tangents to the narrowest part of the radial section, as shown in FIG. 4.

The bridge or radial section supporting the central section may be a part of the top wall, or be made in one piece with the insert containing the projections. The minimum ratio of radius of the main axis over the length of the main axis, or said encompassing angle, is determined by the material of the top wall of the box or the insert, unless a reinforcing structure or some stiffening means is provided. Such a reinforcing structure may be in the form of an embossed pattern in the radial section itself, or an additional piece of material attached to the top wall or insert in the region of the radial section. The stiffening means may itself be provided with an embossed pattern for improved strength.

The above embodiment, describing an opening with a substantially circular main axis, can also be applied to openings with a main axis having a substantially oval shape. In this case, the terms "substantially circular/oval" also includes openings with slightly irregular edges with a general circular/oval shape.

The risk of interference between adjacent opposing projections can be reduced by a number of other factors. For instance, by arranging adjacent projections spaced apart, interference is avoided for both tapered and straight projections, having parallel edges, as well as for projections having a narrower section, or waist, between tip and base. Each embodiment of the invention may include a number of opposing projections of the same shape or of different shape. The number of projections may be the same on either side of the opening, or include N projections on one side and (N+1) on the opposite side, where $N \geqq 1$. The distance between the edges of adjacent projections in their inactive positions, wherein all projections are placed in the same or in parallel planes, can be substantially constant around the entire periphery of each projection. According to a further embodiment, said distance can vary, for example by allowing the tips of the projections to extend closer to their corresponding opposite edges of the opening, or by using projections with a waist between tip and base. In this context, the term "base" is defined as a straight line between the inner ends of a pair of cut-out notches, or such a cut-out notch and an estimated inner end of a cut-out notch, on either side of a projection.

BRIEF DESCRIPTION OF THE DRAWINGS

In the following text, the invention will be described in detail with reference to the attached drawings. These drawings are used for illustration only and do not in any way limit the scope of the invention. In the drawings.

DETAILED DESCRIPTION OF THE INVENTION

Figure 1:
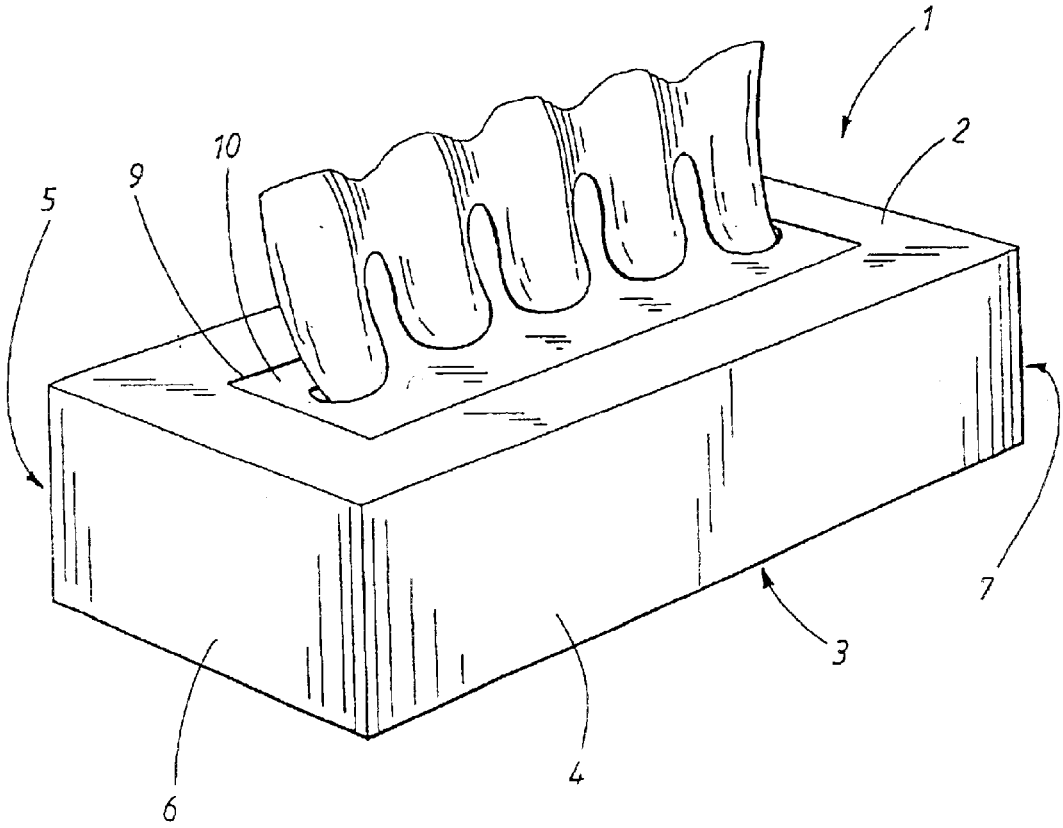
FIG. 1 shows a perspective view of a box according to the invention.

FIG. 1 shows a generally rectangular paperboard dispensing box 1 containing a stack of interfolded tissue-sheets (not shown). By interfolding, all the tissue-sheets in the stack are mechanically connected to each other in a continuous, loosely connected band of individual tissue-sheets. The paperboard box 1 has a top wall 2, a bottom wall 3, two long side walls 4, 5 and two short side walls 6, 7. The stack of tissue-sheets rests with a lower-most tissue-sheet on the inner surface of the bottom wall 3 and has a height that substantially corresponds to the height of the box 1, that is, to the height of the sidewalls 4–7. It is to be understood that the height of the stack of tissue-sheets is to a certain degree determined by the height of the box. The interfolded tissue-sheets are highly compressible and are usually, but not necessarily, compressed before being placed in the box, so that a sufficient amount of tissue-sheets can be accommodated in the box. The figure also shows an uppermost tissue sheet T being held in a presentation position by a number of projections, which will be described in detail below.

Figure 2:
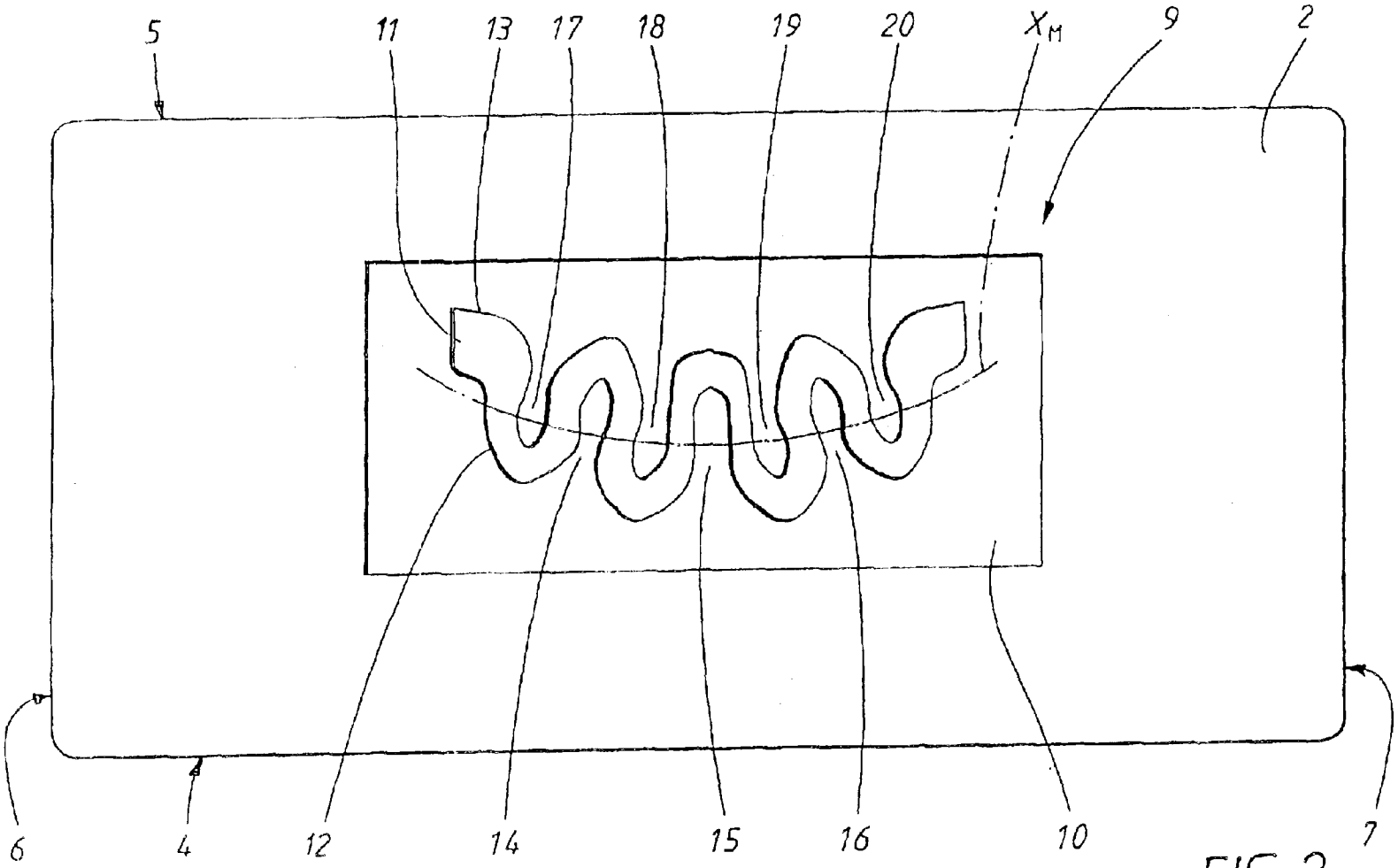
FIG. 2 shows a plan view of a first embodiment of the invention.

The box 1 is provided with an opening 9 in the top wall 2. The opening 9 is arranged substantially centrally in the top wall 2 and extends parallel to the long sidewalls 4, 5. In the example of FIG. 2, the opening 9 has the shape of a straight-sided rectangle. However, an opening in the shape of a circle, an oval, a substantially rectangular shape, having a wider section in its middle portion or other suitable irregular shapes are contemplated within the scope of the invention, as the exact shape of the opening is not relevant to the invention.

Before use of the box of tissue-sheets, the opening 9 is commonly protected by a cover. Usually the protective cover is made of the same paperboard material as the box itself, and is simply a portion of the top wall 2, which can be torn away along a perforated line in the top wall 2. In the Figures the cover has been removed, wherein the outline of the cover is indicated by the opening 9. However other protective devices such as separate pieces of paper, paperboard, plastic film, and the like can be envisaged. Moreover, the box can be provided with a permanently attached or removable regular lid, which is opened to expose the opening in the top wall 2 and which, optionally, can be re-closed.

The box shown in FIG. 2 is also provided with an insert 10, which has been indexed with the first opening 9 and attached to the underside of the top wall 2. A cut-out section has been removed from the insert 10, which cut-out section defines a secondary opening 11 with opposing side edges 12, 13. Said secondary opening is further provided with a number of projections, wherein a set of first projections 14, 15, 16 extend from one side edge 12, and a set of second projections 17, 18, 19, 20 extend from the opposite side edge 13. The tips of said first and second sets of projections extend past each other and a main axis $X_M$ of the secondary opening 11 in a plane parallel with the top wall 2. The said secondary opening 11 has a meandering shape that defines the projections, creating a gap or space between adjacent projections. The secondary opening extends along a main axis having a predetermined curvature with a relatively large radius. In this way, a tissue sheet pulled from the box through the opening 11 will be given a first, or primary, wave shape by the individual projections 14, 15, 16; 17, 18, 19, 20, and a secondary wave-shape, or curvature, by the curved main axis $X_M$.

According to this embodiment, the first set of projections includes three and the second set of projections four discrete projections or fingers. The number of projections may however be varied within the scope of the invention. For instance, the number of projections can be either odd or even, and can also be the same on opposite sides of the opening.

Figure 3:
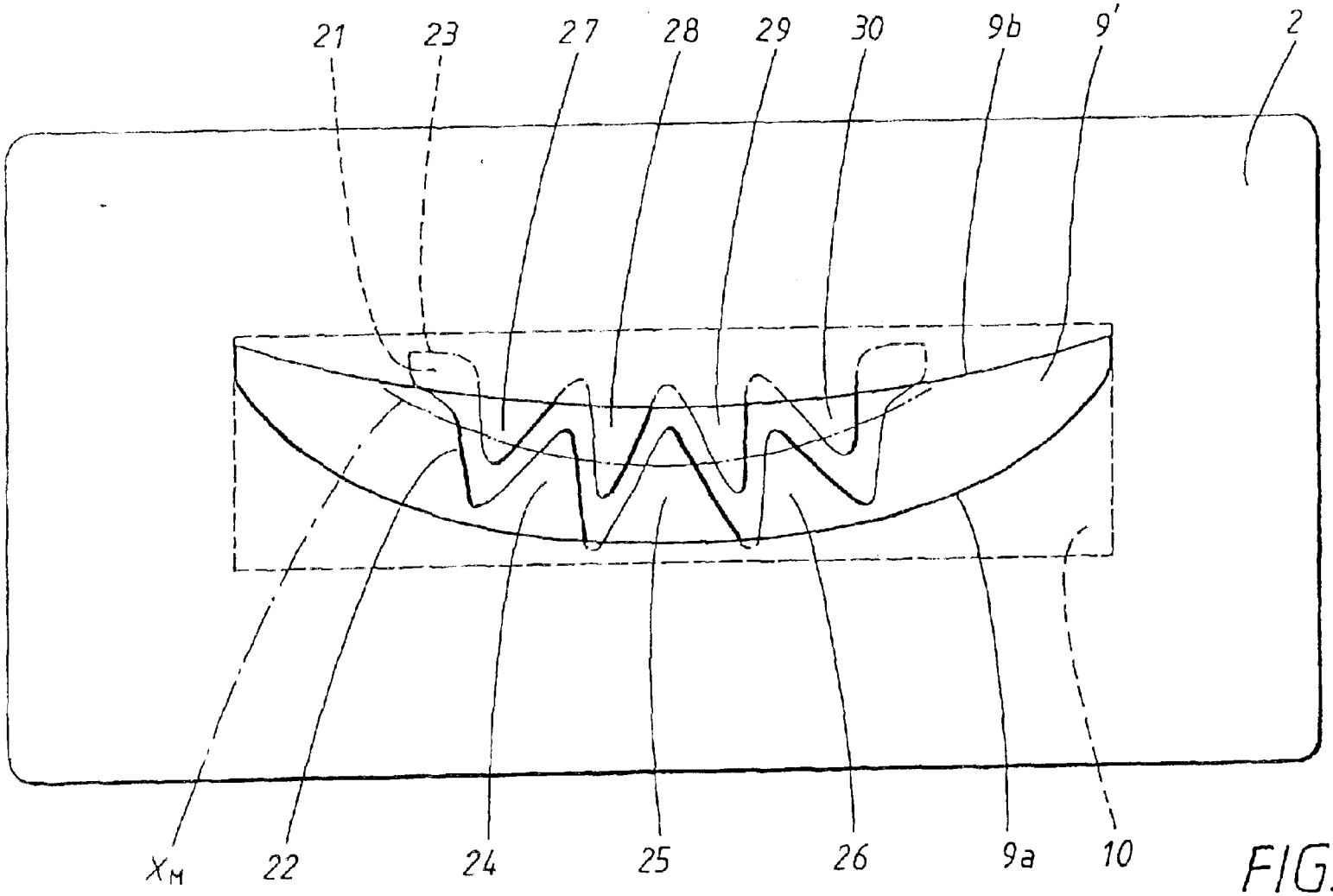
FIG. 3 shows a plan view of a second embodiment of the invention.

FIG. 3 shows an alternative embodiment where the primary opening 9' has been given a crescent shape, whereby a first edge 9*a* of the opening has a curvature with a greater radius than a second, opposite edge 9*b* of the opening. As described in connection with FIG. 2, the insert 10' containing the secondary opening 21 and the projections 24, 25, 26; 27, 28, 29, 30 is indexed with the primary opening 9' and attached to the underside of the top wall 2. However, in this embodiment the secondary opening 21 has a zig-zag shape, which produces projections tapering towards their tips. As can be seen from FIG. 3, the distance between the side edges of adjacent projections is substantially constant, albeit with a somewhat larger distance between the tips and their corresponding opposing edges. The secondary opening 21 has a main axis $X_M$ with a curvature turning in the same general direction as that of the first opening 9', but having a smaller radius than both the radii of the first and second edges 9*a*, 9*b* of said opening.

It is however possible for the radius of the curvature of the main axis $X_M$ to be substantially equal to or smaller than the larger of the above radii, within the scope of the invention. Which of the two edges 9*a*, 9*b* has a curvature with the largest radius is dependent on the positioning of the crescent shaped first opening 9' in the top wall 2.

Figure 4:
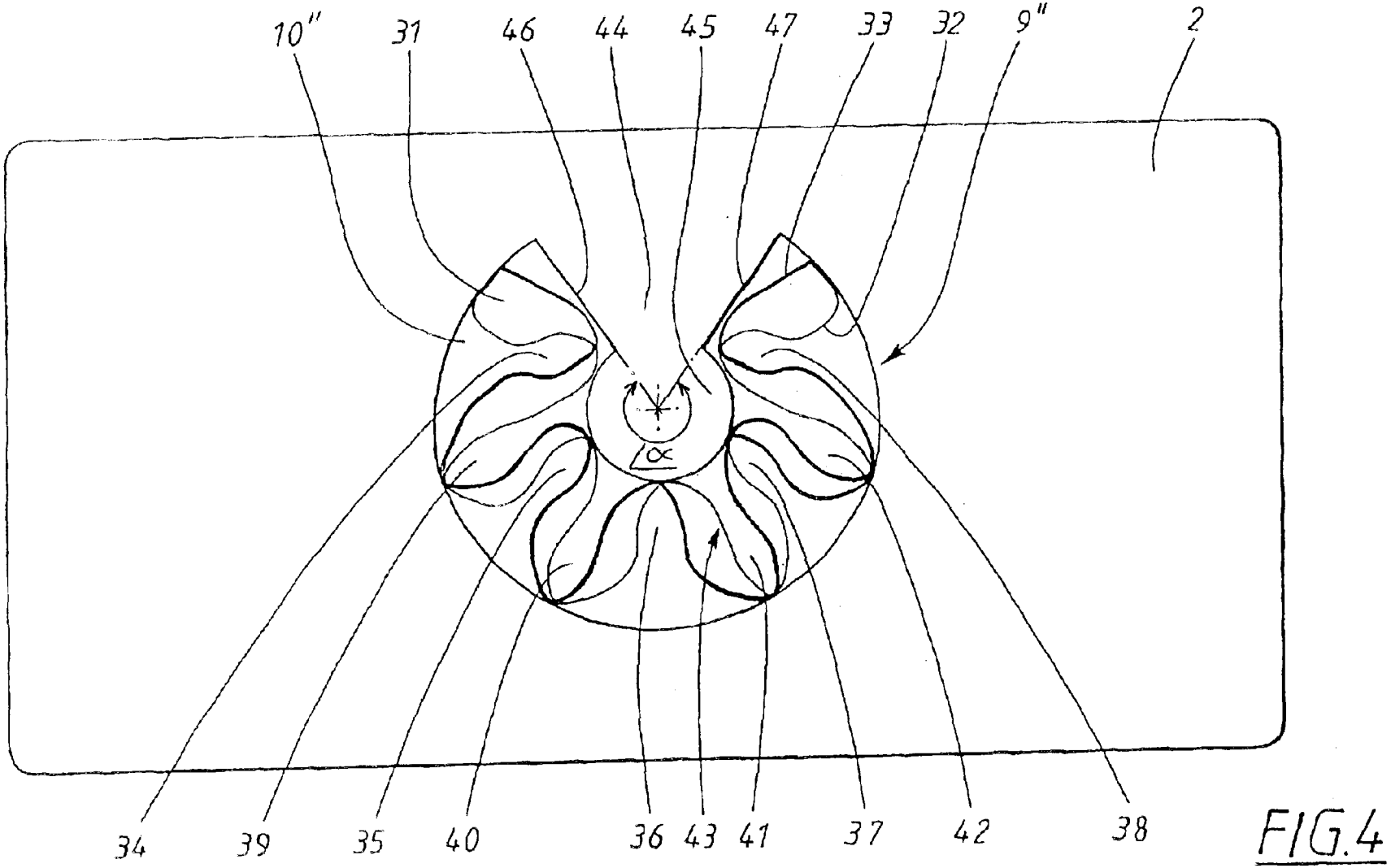
FIG. 4 shows a plan view of a third embodiment of the invention.

FIG. 4 shows a further embodiment where the primary opening 9" has the shape of a circular arc segment that encompasses an angle $\alpha$ of nearly 300°. As described in connection with FIG. 2, the insert 10" containing the secondary opening 31 and the projections 34, 35, 36, 37, 38; 39, 40, 41, 42 is indexed with the primary opening 9" and attached to the underside of the top wall 2. The secondary opening 31 is further provided with a number of projections, wherein a set of first projections 34, 35, 36, 37, 38 extend from one side edge 32, and a set of second projections 39, 40, 41, 42 extend from the opposite side edge 33. Said first and second sets of projections extend past each other and a main axis $X_M$ of the secondary opening 31 in a plane parallel with the top wall 2. The secondary opening 31 has a meandering shape that defines the projections, creating a gap between adjacent projections. The width of the gap between the side edges of adjacent projections varies between a minimum value at their tips to a maximum value between the tip and base of each projection. The varying width of the gap is achieved by providing the projections with a narrowed, waist section 43. However, the shape of each subsequent projection and the width of each corresponding waist section 43 is slightly varied, from the projections 34, 38 at either end of the secondary opening 9" to a middle, or central projection 36 positioned opposite a radial section 44 separating the ends of the secondary opening. In this way, projections on either side of an axis through the centre of the radial section 44 and the central projection 36 are symmetrical.

The radial section 44 is part of the top wall 2 and extends a predetermined distance towards the centre of the primary opening 9". The radial section 44 ends in a central section 45, which has substantially the same basic shape as the outer edge, or periphery of the primary opening 9". The first set of projections 34, 35, 36, 37, 38 extend radially inwards from the outer edge of the opening 9" towards the central section 45, while the second set of projections 39, 40, 41, 42 extend radially outwards from the central section 45. The angle $\alpha$ is measured relative the centre of said central section, from one edge of the primary opening 9" to the other. The insert 10" containing the projections is attached to the underside of the top wall, both outside the outer periphery of the primary opening 9" and under the central section 45.

The insert in this embodiment is made in one piece, but it may also comprise two separate sections, having sets of outer and inner projections respectively. The embodiment also shows a number of non-symmetrical projections, arranged symmetrically on either side of a centre line through the radial section 44 and a central projection 36, but it is also possible to make all projections symmetrical.

Figure 5:
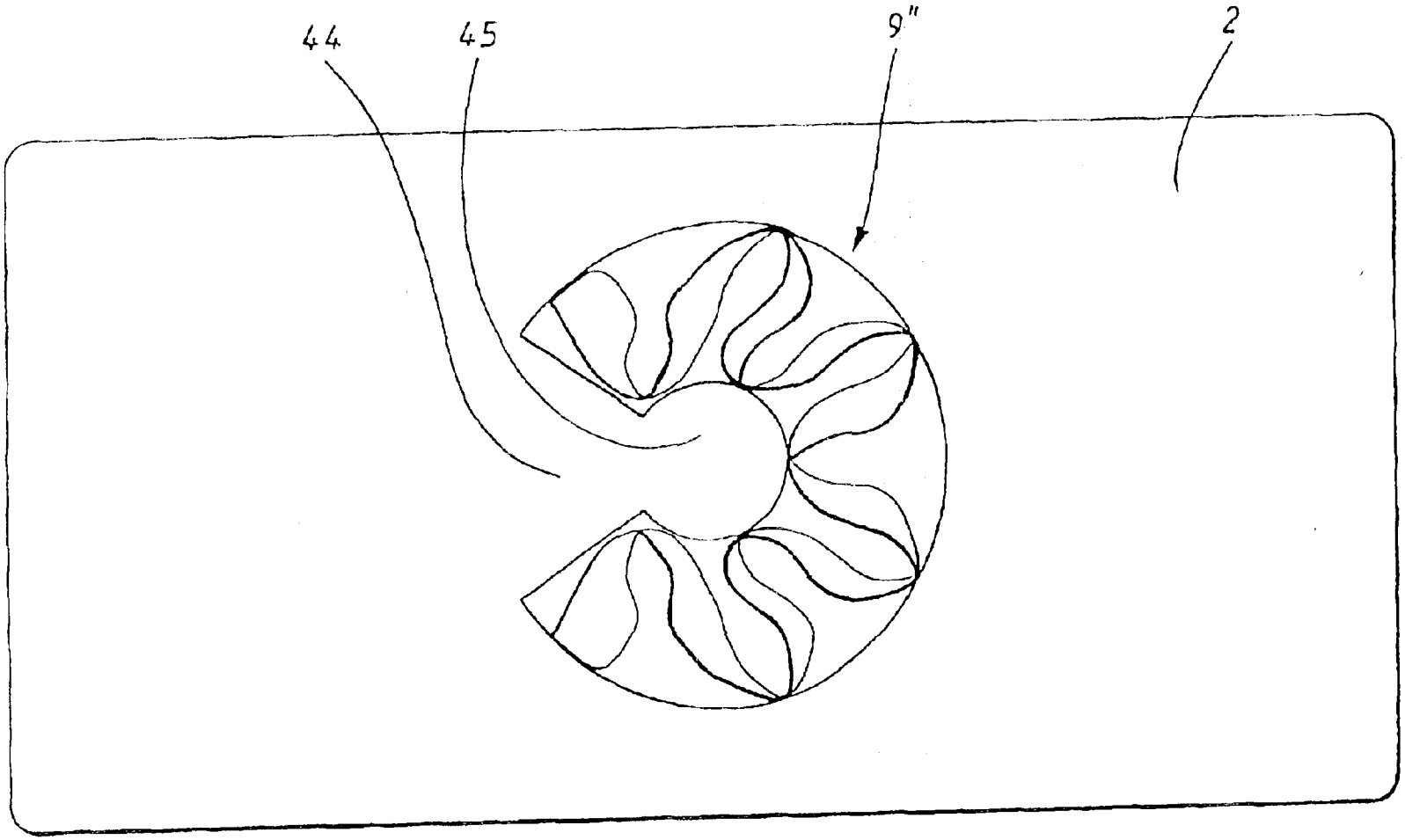
FIG. 5 shows a plan view of a fourth embodiment of the invention.

FIG. 5 shows an alternative embodiment of that of FIG. 4 where the primary opening 9" has been rotated through 90° in the top wall 2. One reason for this re-positioning is that the available space between the opening in the top wall and the edge of the box is not sufficient for supporting a radial section for this particular size of opening. Also, the size or position of the radial section 44, or bridge, may require a reinforcing structure (not shown) that cannot be fitted in the space between the base radial section 44 and the longitudinal edge of the top wall 2. Such a reinforcing structure can be used to control the stiffness and other properties of the radial section and/or to prevent or minimize flexing or folding along a line at the point of transition between radial section 44 and central section 45. A further reason for this repositioning of the primary opening is the orientation or arrangement of the stack of tissues, which re-positioning may facilitate removal of the tissues.

What is claimed is:

1. A container for a stack of interfolded tissue-sheets (T), said container having a generally planar top wall and a bottom wall and side walls connecting said bottom wall with said top wall and an opening provided in at least said top wall for the removal of said tissue-sheets (T) from the container, said stack (T) of interfolded tissue-sheets being placed in said container with at least a pair of edges of a lowermost tissue-sheet placed on said bottom wall and an uppermost tissue-sheet (T1) placed near or in contact with the top wall and adjacent to the opening in the top wall, said opening being provided with projections for presenting the tissue; said projections being elongated and extending in-between each other from opposite sides (x, y) of the opening in a first, inactive position, such that a projection from one side is adjacent to a projection from an opposite side, wherein adjacent projections are spaced apart both in the first, inactive position, in which the projections are substantially in the same plane as the top wall, and in a second, active position, in which the projections are raised and impart a primary wave-shape to a tissue sheet in a presentation position, the opening has a main axis with a predetermined curvature, which opening imparts a secondary wave-shape to said tissue sheet in the presentation position when the projections are in the second, active position, the curvature of the main axis has a substantially closed circular shape, with the ends of the opening placed at a short distance from each other, and the circular main axis encompasses an arc of up to 300°.

2. The container according to claim 1, wherein the length of the curved main axis is substantially equal to or less than the total width of the tissue.

3. The container according to claim 1, wherein the curvature of the main axis has an arc shape.

4. The container according to claim 1, wherein the curvature of the main axis has a substantially closed oval shape.

5. The container according to claim 1, wherein the distance between adjacent projections in their inactive positions is substantially constant around the entire periphery thereof.

6. The container according to claim 1, wherein the distance between the projections in their inactive positions is larger between adjacent side edges than between a tip and its opposing edge.

7. The container according to claim 1, wherein each projection is tapering towards its tip.

8. The container according to claim 1, wherein the distance between the projections varies, each projection having a narrower section between its tip and base.

9. The container according to claim 1, wherein the container is provided with a lid which is opened to expose the opening in the top wall.

10. The container according to claim 9, wherein the lid is removable.

11. The container according to claim 9, wherein the lid is recloseable.

* * * * *